United States Patent [19]

Poister et al.

[11] 3,953,901

[45] May 4, 1976

[54] TOILET STOOL VENTILATING MEANS

[75] Inventors: Clarence E. Poister, Topeka, Kans.; Philip A. Tyrrell, Kansas City, Mo.; Walter D. Hodge, Shawnee Mission, Kans.

[73] Assignee: PK Products/Inc., Wichita, Kans.

[22] Filed: Feb. 11, 1974

[21] Appl. No.: 441,452

[52] U.S. Cl. ..... 4/213; 4/72; 4/217

[51] Int. Cl.[2] ..... E03D 9/04; A47K 13/00

[58] Field of Search ..... 4/209, 213, 217, 214, 4/215, 72

[56] References Cited

UNITED STATES PATENTS

| | | | |
|---|---|---|---|
| 2,227,920 | 1/1941 | Baither | 4/213 |
| 2,297,935 | 10/1942 | Baither | 4/213 |
| 2,351,560 | 6/1944 | Thompson et al. | 4/213 |
| 2,728,088 | 12/1955 | Gudish | 4/217 |
| 2,759,197 | 8/1956 | Majauskas | 4/213 |
| 2,777,137 | 1/1957 | McFadden | 4/213 |
| 2,824,313 | 2/1958 | Bulow | 4/213 |
| 2,824,313 | 2/1958 | Bulow | 4/213 |
| 2,847,682 | 8/1958 | Shay | 4/213 |
| 2,849,727 | 9/1958 | Bollinger et al. | 4/217 |
| 2,985,890 | 5/1961 | Baither | 4/213 |
| 2,988,756 | 6/1961 | Hartley | 4/213 |
| 3,020,564 | 2/1962 | Chadacki et al. | 4/213 |
| 3,108,289 | 10/1963 | Smith | 4/213 |
| 3,287,743 | 11/1966 | Coates | 4/213 |
| 3,335,431 | 8/1967 | Coates | 4/213 |
| 3,386,109 | 6/1968 | Christian et al. | 4/213 |
| 3,469,267 | 9/1969 | Kuklok | 4/213 |
| 3,649,972 | 3/1972 | Sowards | 4/213 |
| 3,790,970 | 2/1974 | Bendersky et al. | 4/213 |
| 3,805,304 | 4/1974 | Ikehata | 4/72 |

*Primary Examiner*—Henry K. Artis
*Attorney, Agent, or Firm*—John H. Widdowson

[57] ABSTRACT

An improved toilet stool having an annular conduit seat with intake openings in communication with the inside of the toilet bowl. The improvement being a ventilating means which comprises an adapter plate situated underneath a tank. The adapter plate has a structure defining a conduit which is in communication with the toilet bowl through the intake openings of the seat. A housed filter element is in communication with the conduit seat through the conduit of the adapter plate, and a means is attached to the filter for removing normally contaminated air from the inside of the toilet bowl through the intake openings, the conduit of the adapter plate, and the filter element, in the order stated, for deodorizing the normally contaminated air and passing it into the surrounding atmosphere. A switch means is connected up to the upper rim of the toilet bowl and is operably connected to the means for removing such that pressure exerted on the top of the seat operates the switch means to activate the means for removing.

4 Claims, 7 Drawing Figures

TOILET STOOL VENTILATING MEANS

BACKGROUND OF THE INVENTION

1. Field of the Invention

This invention relates to a toilet stool ventilating means. More specifically, this invention provides an improved toilet stool ventilating means which utilizes a housed filter element in communication with a conduit of an adapter plate.

2. Description of the Prior Art

Various other types of toilet stool ventilating devices are known in the prior art as operable for removing contaminated air and odors from within a toilet bowl. However, these devices are generally costly to manufacture and unsightly in appearance as well as requiring specially designed toilet bowls and additional air receiving rings or the like attached to the seats or the toilet bowl structure. Additionally, some of these prior art devices require mounting of the filter unit in a remote location not immediately adajcent to the toilet stool which often times then makes it not easily accessible for filter replacement. One known means of ventilating a toilet stool is to attach an inlet conduit to the seat or to the bowl area and connect the conduit to a filtering unit placed elsewhere; this is not generally satisfactory because of the general unsightly appearance of the additional structure needed to be added to the toilet stool and the remotely placed filtering unit. Another common means of ventilating a bathroom is by using ceiling or wall vents to carry contaminated air from the room; this is generally not satisfactory because of removal of a large quantity of heated or air-conditioned air which must be replaced. Therefore, what is needed and what has been invented by me is an improved toilet stool ventilating means without the foregoing deficiences associated with the prior art.

SUMMARY OF THE INVENTION

The present invention accomplishes its desired objects by broadly providing an improved toilet stool mounted on a supporting surface and including a generally annular conduit having an exit aperture and intake openings in communication with the inside of the toilet bowl. The seat circumscribes the upper rim of the toilet bowl when in a lowered position. A tank is mounted on the toilet stool and includes a flushing liquid and means connected therein to supply the flushing liquid to the toilet bowl through a discharge conduit. The improvement is a ventilating means which comprises an adapter plate situated underneath the tank and having the conduit seat pivotally attached thereto. The adapter plate has a structure defining a conduit which is in communication with the exit aperture of the seat. A housed filter element which has an outlet and an inlet is additionally included and is in communication with the conduit seat through the conduit of the adapter. The ventilating means also has a means for removing normally contaminated air from the inside of the toilet bowl through the intake openings, the exit aperture, the conduit of the adapter plate, the inlet and the filter element, in order stated, for deodorizing the normally contaminated air and passing it into the surrounding atmosphere. A switch means is connected to the rim and is operably connected to the means for removing such that pressure exerted on the top of the seat operates the switch means to activate the means for removing.

It is therefore an object of this invention to provide an improved toilet stool ventilating means which overcomes the aforementioned disadvantages associated with prior art devices.

It is another object of this invention to provide an improved toilet stool ventilating means which can be used within a conventional toilet stool structure without substantially altering its appearance.

It is yet another object of this invention to provide an improved toilet stool ventilating means which utilizes a filter, is easy to clean, and is also efficient and relatively economical to manufacture and operate.

These, together with various ancillary objects and features which will become apparent as the following description proceeds are obtained by this novel ventilating means for a toilet stool, a preferred embodiment being shown in the accompanying drawings, by way of example only, wherein:

DETAILED DESCRIPTION OF THE INVENTION

Figure 1:
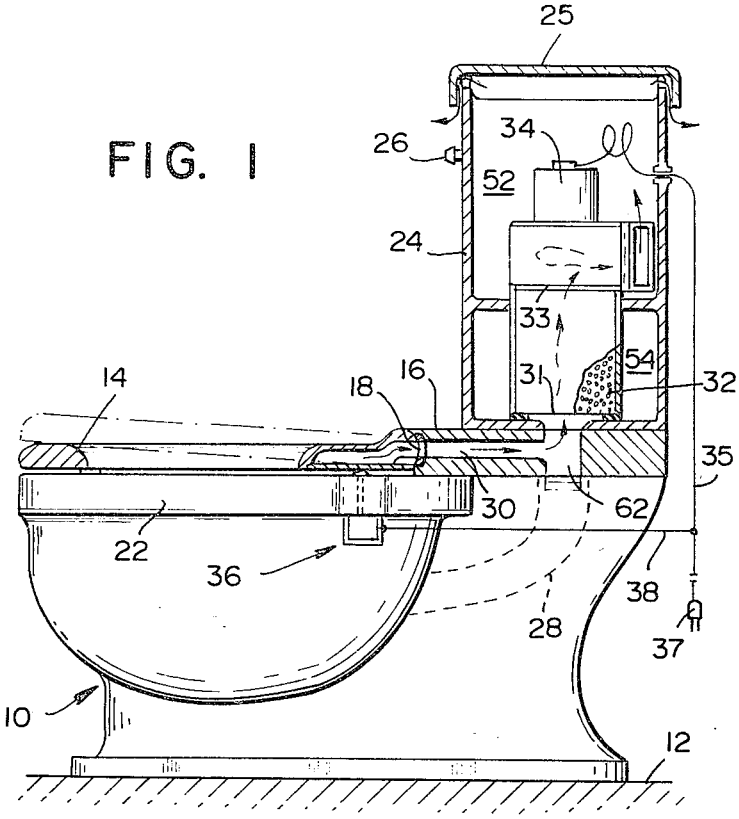
FIG. 1 is a partial vertical sectional view disclosing the filter element and blower housed within the tank behind a watertight partition and in communication with a conduit in the adapter plate.

Referring in detail now to the drawings, wherein similar or like parts of the invention are identified by like reference numerals, a toilet stool, generally illustrated as 10, is mounted on a supporting surface 12 and has an annular conduit seat 14 horizontally and pivotally attached to an adapter plate 16, and is essentially aligned therewith when the seat 14 is in a lowered position as shown in FIGS. 1, 2, 5 and 6. Conduit seat 14 has exit aperture 18 and intake openings 20 which are in communication with the inside of the toilet stool 10. The seat 14 circumscribes an upper rim 22 of the toilet stool 10. A tank 24 with lid 25 is mounted on top of adapter plate 16 and has a flushing liquid 17 and means 26 connected therein to supply the flushing liquid 17 from the tank 24 to the toilet stool 10 through a discharge conduit 28. The adapter plate 16 has a conduit 30 which is in communication with exit aperture 18 and is sealed at 62. The discharge conduit 28 pierces conduit 30 in FIGS. 4 and 6 such that the contaminated air being removed from the toilet stool 10 generally flows around the conduit 30. FIGS. 1–3, and 5 disclose the discharge conduit 30 as being conventional and not piercing conduit 30.

A housed filter (preferably charcoal) element 32 has inlet 31 and outlet 33 and is in communication with conduit 30, and a means 34 is attached to filter 32 for removing normally contaminated air from the inside of the toilet stool 10 through the following: intake openings 20, exit aperture 18, conduit 30, inlet 31, filter 32, and outlet 33, in order stated, for deodorizing the normally contaminated air and passing it into the atmosphere. Means 34 may be any suitable means but is preferably a blower and has a conductor 35 with a plug 37 attached thereto for insertion into a source of power (not shown in the drawings).

A switch means, generally indicated as 36, is connected to rim 22 and is electrically operably connected by conductors 38 to conductor 35 such that pressure exerted on the top of seat 14 operates switch means 36 to activate the means for removing 34. Switch means 36 may be any suitable switch which is capable of closing an electrical circuit. Preferably, switch means 36 is a plunger-type as fully disclosed in FIG. 7.

Figure 7:
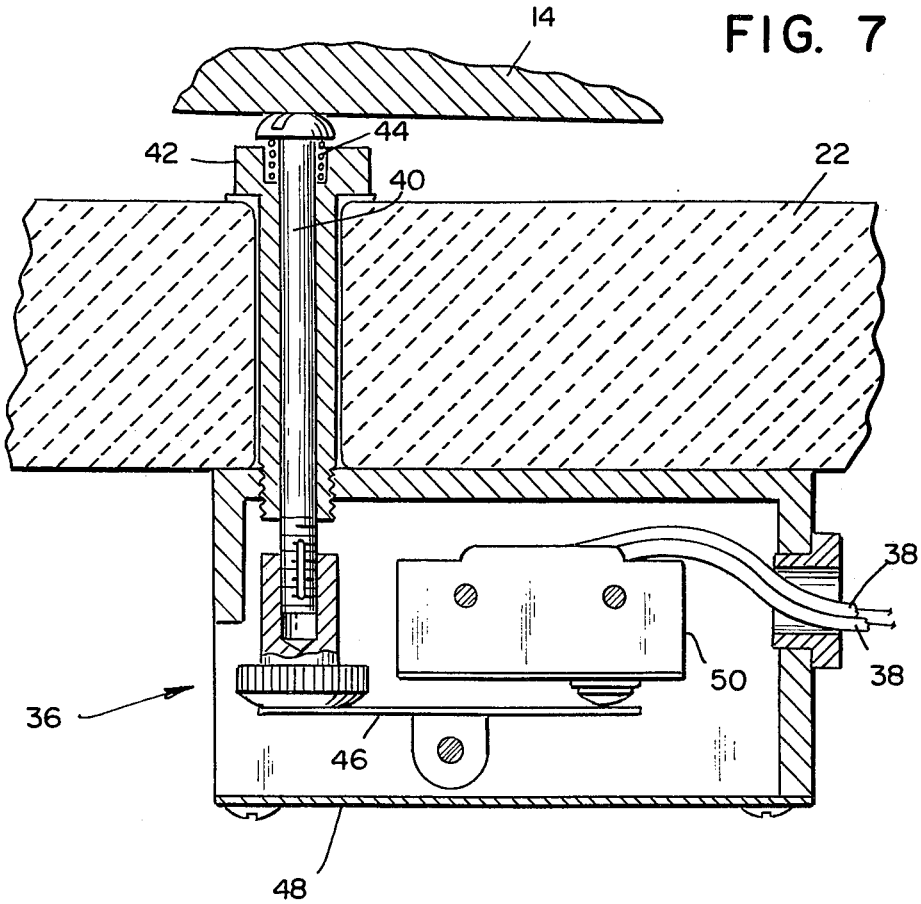
FIG. 7 is a partial enlarged vertical sectional view of the switch means which activates the blower when pressure is applied to the toilet seat.

FIG. 7 shows seat 14 compressing a plunger 40 which is slidably lodged within a sleeve 42 having a spring 44 for upwardly biasing the plunger 40 against the seat 14 when it is not being used. Contact bar 46 is pivotally fastened within housing 48 and is pivoted against a micro-switch 50 (well known within the art) by the downward force of the plunger 40. Mirco-switch 50 closes the circuit and activates the blower 34.

Figure 2:
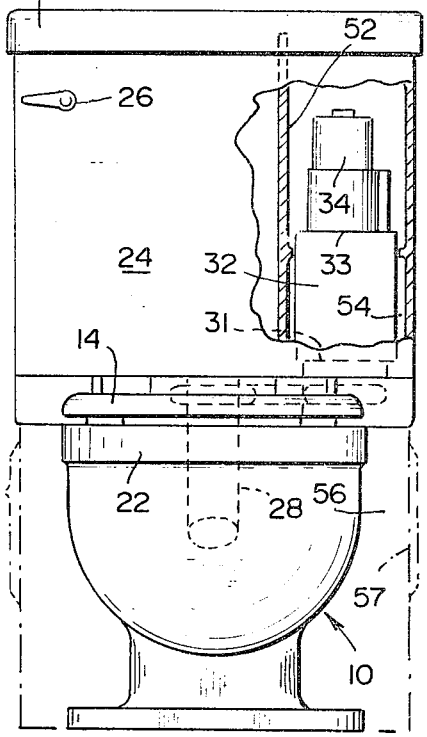
FIG. 2 is a front elevational view of the toilet stool of FIG. 1 having a cut away portion showing the watertight partition separating the filter element and the blower from the flushing liquid.
Figure 5:
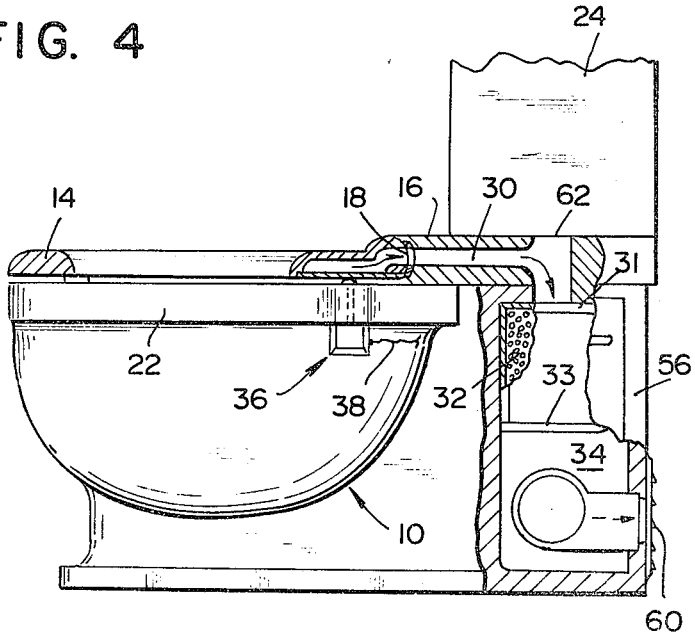
FIG. 5 is a fragmentary vertical sectional view disclosing the filter element and blower housed with a compartment connected underneath the adapter plate.

Filter element 32 and the blower 34 attached thereto have two preferred embodiments for their location. FIGS. 1 and 2 disclose a first embodiment showing the filter 32 and blower 34 removably housed in the tank 24. A watertight partition 52 is attached to the internal walls of the tank 24 to prevent filter 32 and blower 34 from being inundated with flushing liquid 17. Filter 32 is lodged in compartment 54. FIG. 5 discloses a second embodiment where filter 32 and blower 34 are removably housed in a compartment 56 which is attached underneath the adapter plate 16 and has a door 57. Embodiment one discharges purified air from underneath the lid 25 (see FIG. 1), and the second embodiment discharges purified air into the surrounding atmosphere through louvers 60 (see FIG. 5).

With continual reference to the drawings for operation of the invention, seat 14 (normally biased upward by a spring which is not shown in the drawings) when used is lowered such that plunger 40 is driven against contact bar 46 which causes micro-switch 50 to close the electrical circuit on conductors 38 and 35 and activate the blower 34. When operating the blower 34 creates a vacuum through filter 32 and conduit 30 such that contaminated air within stool 10 is sucked through intake openings 20, through conduit 30, and through filter 32 wherein purification takes place. Purified air egresses through outlet 33 and is blown into the surrounding atmosphere by blower 34 either through louvers 60 (FIG. 5) or underneath lid 25 (FIG. 1).

Figure 4:
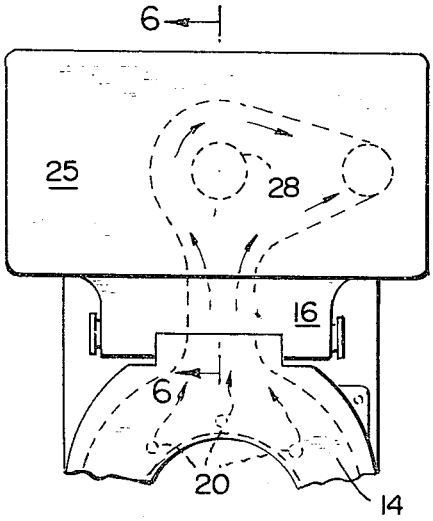
FIG. 4 is a partial top plan view of another embodiment of the stool and tank disclosing in dashed lines the adapter plate conduit being pierced by a flushing liquid discharge conduit.
Figure 3:
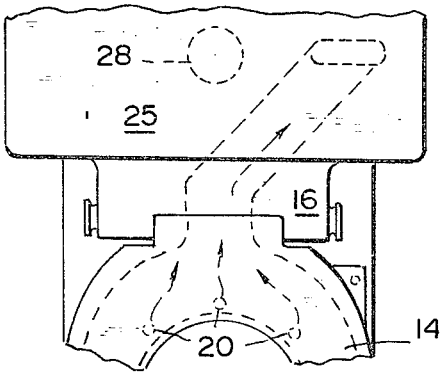
FIG. 3 is a partial top plan view of the stool and tank disclosing in dashed lines an embodiment of the adapter plate conduit.
Figure 6:
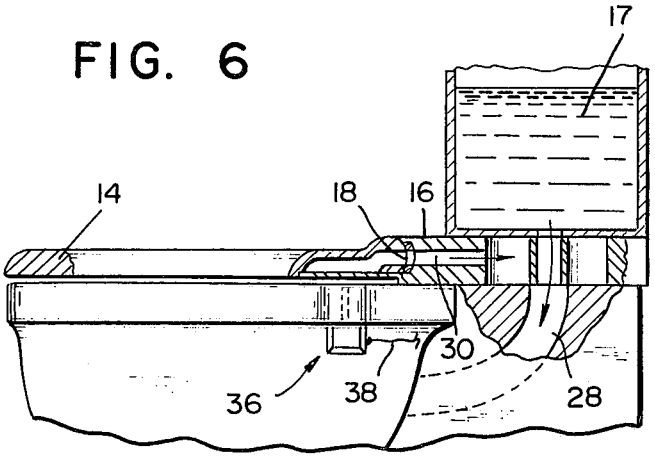
FIG. 6 is a partial vertical sectional view taken along the line 6—6 in FIG. 4.

The path which the normally contaminated air takes to the inlet 31 of filter 32 depends on whether the embodiment in FIG. 3 is being used or the embodiment of FIG. 4 which causes the contaminated air to be swirled around discharge conduit 28 is being used. As aforementioned the embodiment of FIG. 3 discloses the discharge conduit 28 as not piercing the conduit 30 and is somewhat conventional. After pressure is released from the top of seat 14 it is upwardly biased by a spring (not shown in the drawings) such that seat 14 is lifted off the top of plunger 40. This causes spring 44 to upwardly bias the plunger away from the contact bar to open the electrical circuit on conductors 38 and 35 and deactivate the blower 34.

While the present invention has been described herein with reference to particular embodiments thereof, a latitude of modification, various changes and substitutions are intended in the foregoing disclosure, and in some instances some features of the invention will be employed without a corresponding use of other features without departing from the scope of the invention as set forth.

We claim:

1. An improved toilet stool mounted on a supporting surface and including a generally annular conduit seat having an exit aperture and intake openings in communication with the inside of the toilet bowl, said seat circumscribing the upper rim of said toilet bowl when in a lower position, a tank supported on a rearwardly extending portion of said toilet stool behind said toilet bowl, having a flushing liquid and means connected therein to supply the flushing liquid to the toilet bowl through a discharge conduit, the improvement being:

a. a ventilating means which comprises an adapter plate situated underneath said tank and having said conduit seat pivotally attached thereto and including a structure defining a conduit which is in communication with said exit aperture of said seat, said conduit of said adapter plate having the outlet thereof substantially spaced from said toilet bowl to one side and opening at a point underneath an end portion of said tank, b. a housed filter element having an outlet, and an inlet, said filter element inlet being communicably connected with said outlet of said conduit of said adapter plate, and c. means attached to said filter for removing normally contaminated air from the inside of said toilet bowl through said intake openings, said exit aperture, said conduit of said adapter plate, said inlet and said filter element, in order stated, for deodorizing said normally contaminated air and passing it into the surrounding atmosphere, d. switch means connected to said rim and electrically operably connected to said means for removing such that pressure exerted on the top of said seat operates said switch means to activate said means for removing, e. said adapter plate is horizontally attached to the rear of said seat and is essentially aligned therewith when said seat is in a lowered position, f. said filter element inlet being situated immediately contiguous to said inlet of said conduit of said adapter plate and communicably connected therewith, g. said tanks has a watertight partition uprightly attached to the internal sides of said tanks forming a compartment in said tank with said partition separating said flushing liquid from said compartment, and said tanks having an aperture through the bottom thereof in said compartment at one end portion thereof, h. said filter element and said means for removing contaminated air being removably lodged within said compartment, and i. said conduit of said adapter plate being communicably connected to said aperture in said tank.

2. The ventilating means of claim 1 wherein said discharge conduit pierces said conduit of said adapter plate such that contaminated air being removed from said toilet bowl generally flows around said discharge conduit.

3. An improved toilet stool mounted on a supporting surface and including a generally annular conduit seat having an exit aperture and intake openings in communication with the inside of the toilet bowl, said seat circumscribing the upper rim of said toilet bowl when in a lowered position, a tank supported on a rearwardly extending portion of said toilet stool behind said toilet bowl, having a flushing liquid and means connected therein to supply the flushing liquid to the toilet bowl through a discharge conduit, the improvement being:

a. a ventilating means which comprises an adapter plate situated underneath said tank and having said conduit seat pivotally attached thereto and including a structure defining a conduit which is in communication with said exit aperture of said seat, said conduit of said adapter plate having the outlet thereof substantially spaced from said toilet bowl to one side and opening at a point underneath an end portion of said tank, b. a housed filter element having an outlet and an inlet, said filter element inlet being communicably connected with said outlet of said conduit of said adapter plate, and c. means attached to said filter for removing normally contaminated air from the inside of said toilet bowl through said intake openings, said exit aperture, said conduit of said adapter plate, said inlet and said filter element, in order stated, for deodorizing said normally contaminated air and passing it into the surrounding atmosphere, d. switch means connected to said rim and electrically operably connected to said means for removing such that pressure exerted on the top of said seat operates said switch means to activate said means for removing, e. said adapter plate is horizontally attached to the rear of said seat and is essentially aligned therewith when said seat is in a lowered position, f. said filter element inlet being situated immediately contiguous to said inlet of said conduit of said adapter plate and communicably connected therewith, g. said ventilating means has a compartment attached underneath said adapter plate wherein said filter element and said means for removing are removably lodged, h. said filter element and said means for removing contaminated air being removably lodged within said compartment, and i. said conduit of said adapter plate being communicably connected to said filter element and said means for removing.

4. The ventilating means of claim 3 wherein said discharge conduit pierces said conduit of said adapter plate such that contaminated air being removed from said toilet bowl generally flows around said discharge conduit.

* * * * *